US005701859A

United States Patent [19]

Edlund

[11] Patent Number: 5,701,859

[45] Date of Patent: Dec. 30, 1997

[54] COMPRESSION RELEASE VALVE FOR A COMBUSTION ENGINE

[75] Inventor: Dag Edlund, Huskvarna, Sweden

[73] Assignee: Aktiebolaget Electrolux, Stockholm, Sweden

[21] Appl. No.: 658,712

[22] Filed: Jun. 5, 1996

[30] Foreign Application Priority Data

Jul. 5, 1995 [SE] Sweden ..... 9502437

[51] Int. Cl.[6] ..... F02N 17/08

[52] U.S. Cl. ..... 123/182.1

[58] Field of Search ..... 123/182.1

[56] References Cited

U.S. PATENT DOCUMENTS 4,414,933 11/1983 Pribnow ..... 123/182.1

4,703,723 11/1987 Tamba et al. ..... 123/182.1

*Primary Examiner*—Andrew M. Dolinar

*Attorney, Agent, or Firm*—Pearne, Gordon, McCoy & Granger LLP

[57] ABSTRACT

The present invention relates to a compression release valve (10;10';10";10'") for a combustion piston engine, said valve including a housing (12;12";12'") with a chamber (20;20';20'") having a passage (24;24";24'") in direct connection with the combustion chamber (22;22") of the engine and outlet means (26;26";26'") connected to the atmosphere or a space separated from the combustion chamber (22;22"). The compression release valve according to the present invention is characterized by being fully automatic. The function of the compression release valve is based on the fact that the valve includes elements of material having different coefficients of thermal expansion.

14 Claims, 3 Drawing Sheets

COMPRESSION RELEASE VALVE FOR A COMBUSTION ENGINE

BACKGROUND OF THE INVENTION

The present invention relates to a compression release valve for a combustion piston engine, said valve including a housing with a chamber having an inlet connected to the combustion chamber of the engine and an outlet connected to the atmosphere or a space separated from the combustion chamber.

Compression release valves are used in combustion engines to reduce the required starting effect, especially for engines being equipped with manually operated starting devices, e.g. chain sawes and the like, but also for engines having electrically operated starting equipment, since said equipment in such a case can have less dimensions.

A conventional design of a known compression release valve defines a valve that is opened manually before the engine is started and closed automatically when the engine has started. A drawback in such an arrangement is that the valve must be easily accessible, this is not always effected in a simple way, e.g. in the case of engine units that are carried on the back. A further drawback is that the manual operation of the valve constitutes an extra working moment that makes the preparations for starting of the engine more long-winded.

From U.S. Pat. No. 4,414,933 a fully automatic compression release valve is previously known, said valve including a bimetal disc that assumes a curved shape when the engine is started and the disc is heated. With the aid of the combustion pressure a venting hole is sealed, said venting hole emanating from the combustion chamber. Thus, it is a question of using the change in shape of the bimetal, said change being dependent upon the temperature, and also secure sealing by the combustion pressure. As regards the structural design of the compression release valve according to U.S. Pat. No. 4,414,933 it should be observed that the bimetal disc does not directly adjoin the combustion chamber but via a venting hole. This means that the reaction of the bimetal disc will be delayed both in sealing and opening of the venting hole. Due to the fact that gases from the combustion chamber during running of the engine heat the cast aluminium that holds the bimetal disc it seems very likely that after the engine is shut off it takes a certain time before the compression release valve opens. This is important since shut off and restart of the engine often takes place in immediate cronological order.

The aim of the present invention is to eliminate the drawbacks discussed above in the known automatic compression release valve discussed above. This is achieved by a compression release valve that has been given the characteristics of the appending claims.

SUMMARY OF THE INVENTION

According to the present invention a compression release valve for a combustion piston engine, which has a cylinder and a combustion chamber, includes a housing separate from the cylinder and having a chamber, and an element at least partly received in the chamber and having an end portion directly exposed in the combustion chamber. The housing also has at least one hole that connects the chamber to a space separated from the combustion chamber and a passage which connects the chamber to the combustion chamber. The element is made out of a material having a different coefficient of thermal expansion than the material that the housing is made out of so that upon rise of the temperature in the combustion chamber, a relative displacement between the element and the housing occurs which seals the passage.

BRIEF DESCRIPTION OF THE DRAWINGS

Below a number of embodiments of the invention will be described, reference being made to the accompanying drawings, wherein.

DETAILED DESCRIPTION OF PREFERRED EMBODIMENTS

Figure 1:
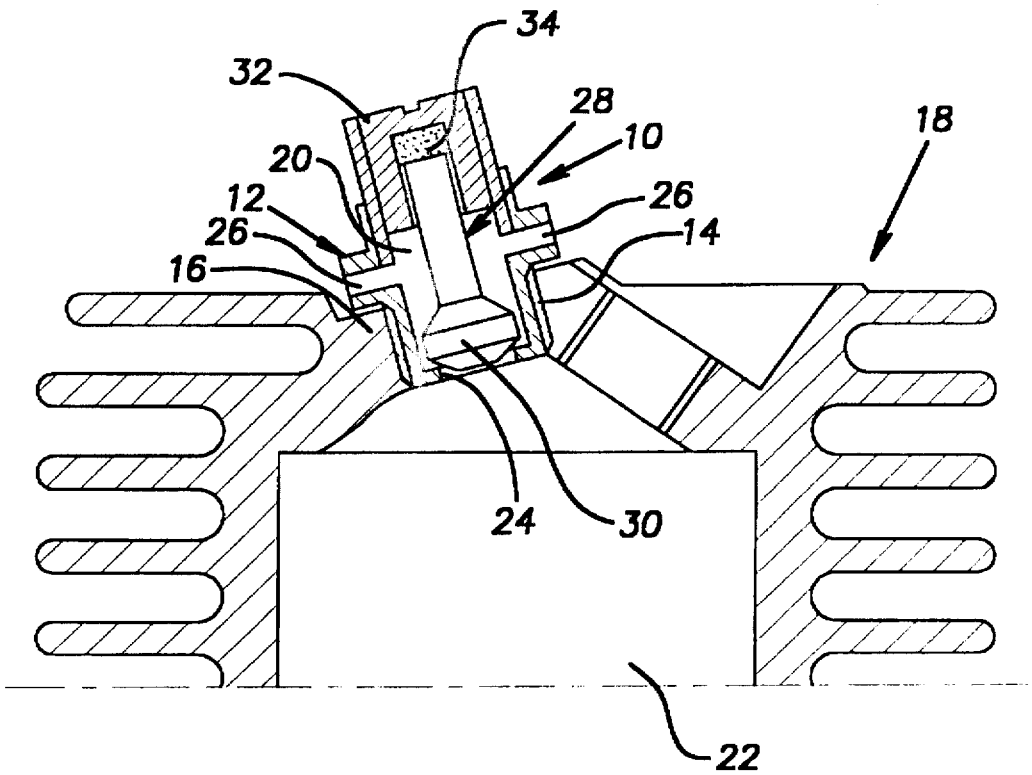
FIG. 1 is an elevational view, in partial cross-section, of a portion of a cylinder of an engine which includes a compression release valve according to the present invention.
Figure 2A:
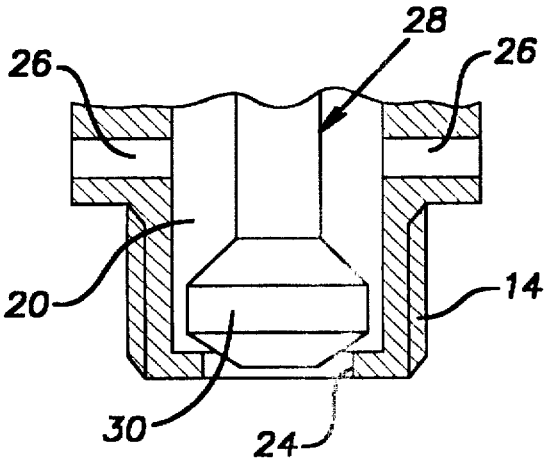
FIGS. 2*a* and 2*b* are enlarged views of a portion of the compression release valve of FIG. 1 wherein dimensional changes are exaggerated for clarity reasons.
Figure 2B:
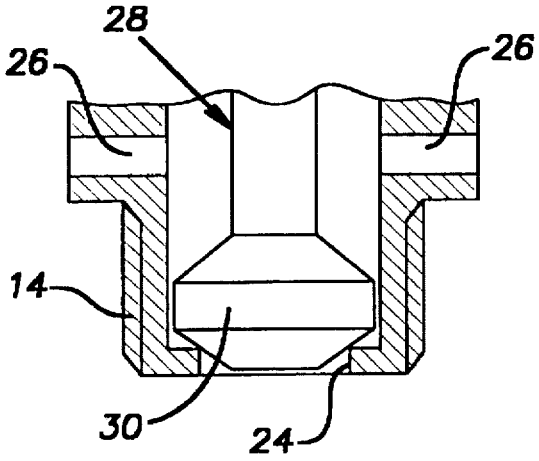

The compression release valve 10 shown in FIGS.1 and 2*a*, 2*b* includes a housing 12 having a threaded socket 14 that is received in a correspondingly threaded hole in a cylinder wall 16 of a, in FIG. 1 partly shown, cylinder 18 of a combustion piston engine. The housing 12 includes a chamber 20 that is connected to the combustion chamber 22 of the engine via an opening 24. The chamber 20 is connected to the atmosphere via a number of radial holes 26 in the housing 12.

In the chamber 20 a bulb/valve element 28 is received, said bulb/valve element 28 being provided with a cone 30 at its end facing towards the opening 24, said cone 30 cooperating with the opening 24. The end of the bulb/valve element 28 facing away from the opening 24 is received in a recess in a plug 32, the free surface of said end abut an insulation disc 34 in the recess. The insulation disc is made out of a material having a low coefficient of thermal conductivity, e.g. glass. The plug 32 is received in the housing via a thread connection.

The housing 12 is made out of a material having low coefficient of heat expansion, e.g. lower than $2\times10^{-6}$/C°. A suitable material for the housing 12 is the nickel steel Invar (36% nickel). The bulb/valve element 28 is made out of a material having a high coefficient of heat expansion, e.g. in the magnitude of $26\times10^{-6}$/C°. A suitable material for the bulb/valve element 28 is magnesium or another light metal having a relatively high melting point.

The device described above functions in the following way. When the engine is not running the bulb/valve element 28 assumes the position shown in FIG. 2*a*, i.e. the cone 30 does not seal against the opening 24 but there is a gap between the bulb/valve element 28 and the opening 24, said gap preferably being in the magnitude of 0.1–0.2 mm. This means av evacuation area of 1–3 $mm^2$ depending on the dimensions of the valve, said dimensions being adapted to the cylinder volume of the engine. In FIG. 2*a* the dimensions of the gap are exaggerated for clarity reasons.

When the motor is to be started, either manually or with the aid of a starter motor, a certain gas flow can pass through the gap between the opening 24 and the cone 30 and then via the chamber 20 and the radial holes 26 out into the atmosphere. This means that the compression decreases and the engine is turned easier, regardless if it is carried out manually or by a motor. When the engine has started there is, due to the combustion, immediately a very rapid heating of the bulb/valve element 28 since the cone 30 is directly exposed against the combustion chamber 22. The bulb/valve element 28 thereby expands axially, the cone 30 seals against the opening 24 since the axial expansion of the housing 12 is essentially less than that of the bulb/valve element 28. As indicated in FIG. 2*a* and 2*b* also a radial expansion of the bulb/valve element 28 takes place. In the figures the radial expansion of the cone is most appearent. However, the dimension relations must be such that no contact occurs between the periphery of the cone 30 and the inner wall of the chamber 20.

In this connection it should be pointed out that the width of the gap is of great importance. As soon as the engine is not running the gap must be sufficiently small to give sufficiently high compression to start the engine and simultaneously the gap must be sufficiently large to avoid a too high compression in the starting moment.

As long as the engine is running the bulb/valve element 28 is subjected to a very strong heat exposure with very few possibilities to carry off the heat due to the fact that the isolation disc 34 is manufactured out of a material having a low coefficient of thermal conductivity. Further the contact of the cone 30 against the opening 24 is along a circle line, this also giving rise to small possibilities of carrying off the heat from the bulb/valve element 28 to the housing 12.

Since the combustion in the combustion chamber 22 takes place at a temperature of 700–800° C. the bulb/valve element is exposed to this temperature. As soon as the combustion ceases, i.e. when the engine has come to a stop, there is instantly a drastic lowering of the temperature in the combustion chamber 22 down to about 200° C. Consequently the gap between the opening 24 and the cone 30 is re-created in a very short time, i.e. a few seconds. This means that the compression release valve according to the invention in principle always functions even in case of very quick re-starting.

Figure 3:
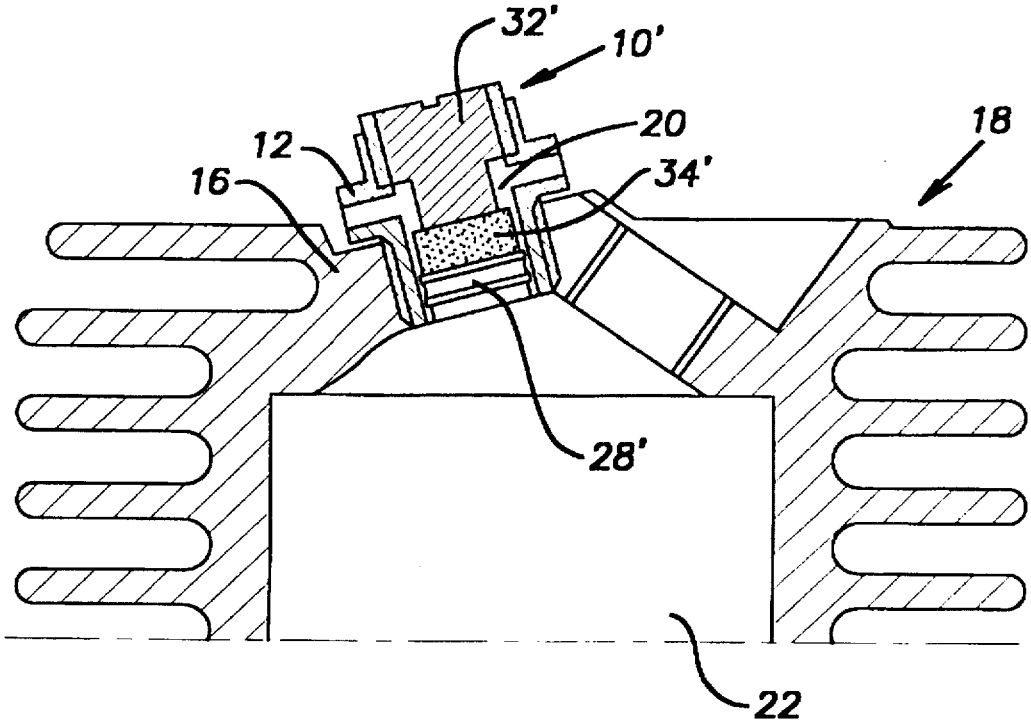
FIG. 3 is an elevational view, in partial cross-section, of an alternative embodiment of the compression release valve of FIG. 1.
Figure 4A:
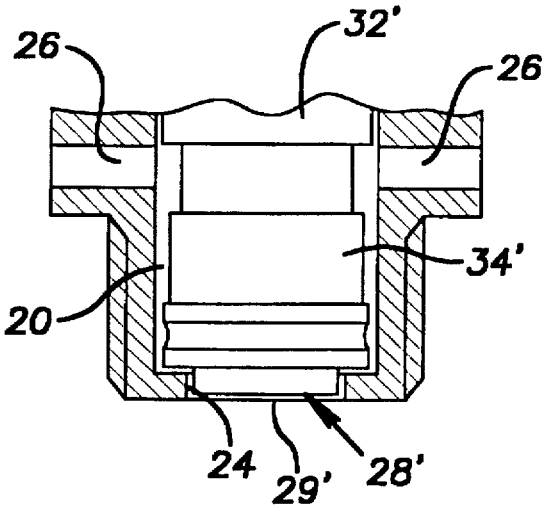
FIGS. 4*a* and 4*b* are enlarged views of a portion of the compression release valve of FIG. 3 wherein dimensional changes are exaggerated for clarity reasons.
Figure 4B:
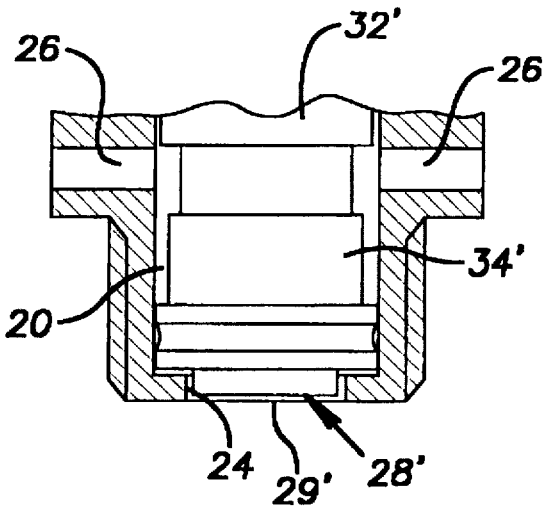

The embodiment described in FIG. 3, 4*a* and 4*b* of a compression release valve 10' differs from the one described above through the design of the bulb/valve element 28', the plug 32' and the insulation disc 34'. The remaining details are in principle identical with the details of the embodiment described above and therefore said details have been given the same reference numerals.

The bulb/valve element 28' has in principle the shape of a shim having a circular cross-section in a plane transverse to the longitudinal extension of the bulb/valve element 28'. A pigot 29' of the bulb/valve element 28' is located in the opening 24, said pigot 29' having the aim of displacing the exposure surface closer to the combustion chamber 22. The remaining part of the bulb/valve element 28' has a diameter that exceeds the diameter of the opening 24, this being a guarantee that the bulb/valve element 28' is retained in the chamber 20. The diameter of the bulb/valve element 28' is adapted to the diameter of the chamber 20 in such a way that when the engine is not running there is a gap between the bulb/valve element 28' and the wall of the chamber 20, see FIG. 4*a*. The dimensions of said gap are exaggerated for clarity reasons.

The gap has the effect that the pressure increase that occurs in the combustion chamber when the engine is started, either manually or via the starter motor, elevates the bulb/valve element 28' somewhat, see FIG. 4*a*, in order to admit gas to flow out through the opening 24 and bypass the bulb/valve element 28', said gas being discharged to the atmosphere via the radial holes 26.

When the engine has started there is instantly, through the combustion, a very rapid heating of the bulb/valve element 28' due to the fact that the spigot 29' is directly exposed towards the combustion chamber 22. The bulb/valve element 28' then expands and the radial expansion brings about that the periphery of the bulb/valve element 28' will sealingly contact the wall of the chamber 20, see FIG. 4*b*. In the disclosed embodiment the bulb/valve element 28' is designed with two axially separated sealing surfaces. This is only an example of different sealing arrangements that are possible. There is also an axial expansion that not is used for sealing purposes in this embodiment.

The materials of the housing 12 and the bulb/valve element 28', as well as the gap and the evacuation area are preferably the same as for the embodiment described above. Thus the function of the re-start described in connection with said above embodiment is also pertinent for the embodiment according to FIGS. 3, 4*a* and 4*b*.

In this connection it should be pointed out that for both the described embodiments a sealing against the pressure in the combustion chamber 22, i.e. the pressure in the combustion chamber 22 does not support the sealing but is rather acting to abrogate the sealing. Within the scope of the invention it is possible to have a sealing arrangement that is designed in such a way that the pressure in the combustion chamber supports the sealing in connection with the thermal expansion, i.e. sealing is effected when the bulb/valve element is allowed to expand in a direction away from the combustion chamber 22. In such a case it is likely that a spring is acting on the bulb/valve element to maintain a gap when the engine is not running.

Figure 5:
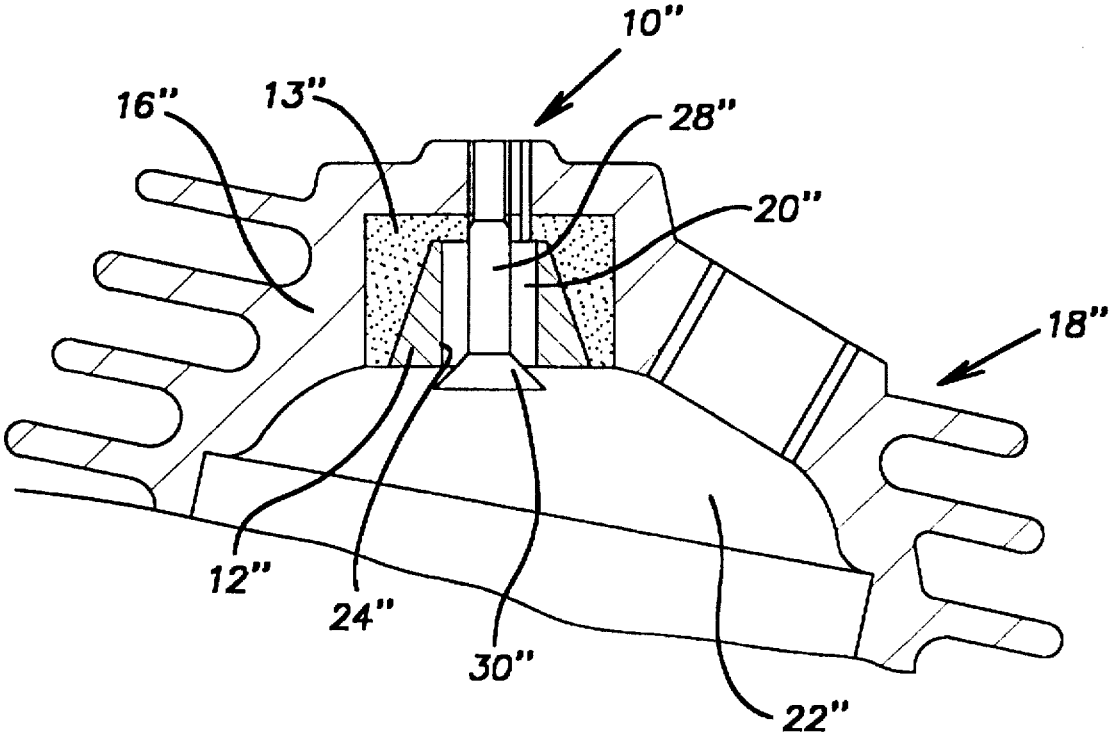
FIG. 5 is an elevational view, in partial cross-section, of a further embodiment of the compression release valve of FIG. 1.

The embodiment of the compression release valve 10" disclosed in FIG. 5 includes a housing 12" made out of a material having a relatively seen high coefficient of heat expansion while the bulb/valve element 28" is made out of a material (Invar) having a relatively seen low coefficient of thermal expansion, i.e. the coefficient of thermal expansion for the housing 12" is essentially higher than that of the bulb/valve element 28".

As is evident from FIG. 5 the housing 12" is received in the wall 16" of the cylinder 18", said housing 12" being surrounded by an insulation 13" that to a great extent prevents heat transmission from the housing 12" to the wall 16" of the cylinder 18".

The housing 12" has a chamber 20" that is partly the location of the bulb/valve element 28". At its end facing towards the combustion chamber the bulb/valve element 28" has a cone 30". Said cone 30" cooperate with the open end 24" of the chamber facing towards the combustion chamber. When the engine is not running there is a gap between the open end 24" and the cone 30". The end of the bulb/valve element 28" that is facing away from the combustion chamber is secured in the wall 16" of the cylinder, e.g. by a thread connection. A channel 26" extends from the chamber 20" to the atmosphere.

The embodiment according to FIG. 5 functions in such a way that when the engine is not running the valve assumes the position of FIG. 5, i.e. compression gases are discharged via the open end 24", the chamber 20" and the channel 26"

to the atmosphere. As soon as the engine starts a rapid axial thermal expansion of the housing 12" will take place, the open end 24" seals against the cone 30". It should be noted that the sealing is effected through linear contact and more specifically through a circle line. Thereby the heat transmission from the housing 12" to the cone 30" is reduced.

When the engine comes to a stop there is a rapid decrease in temperature in the combustion chamber and the gap between the open end 24" and the cone 30" is re-established almost instantly.

According to the embodiments described above the compression release valve is located in the cylinder. Within the scope of the invention it is also possible that the compression release valve is located in the piston as is the case in FIG. 6.

Figure 6:
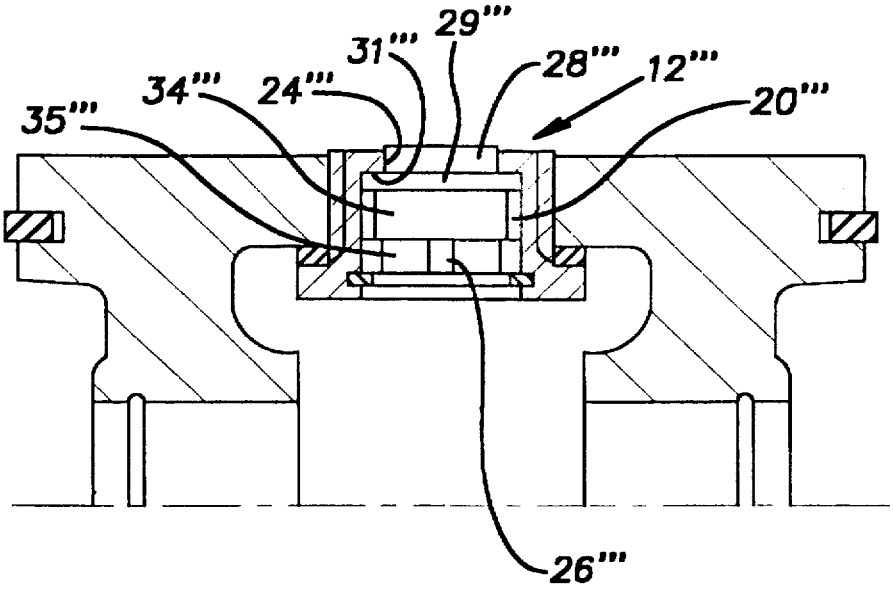
FIG. 6 is an elevational view, in partial cross-section, of still a further embodiment of the compression release valve of FIG. 1.

In the embodiment according to FIG. 6 the valve housing 12'" is received in the upper part of the piston, said housing 12'" in the disclosed embodiment being threadily connected to the piston. A bulb/valve element 28'" is received in a chamber 20'" in the housing 12'". The bulb/valve element 28'" has one end exposed towards the combustion chamber 22'" while the other end contacts an insulation disc 34'" also received in the chamber 20'". The insulation disc 34'" is made out of a material having a low coefficient of thermal conductivity, e.g. glass.

The insulation disc 34'" contacts in its turn a support disc 35'" that is provided with axial slots 26'" in its periphery to effect evacuation of gases from the combustion chamber before the engine has started and the valve is closed. The support disc 35'" is carried by a locking ring 36'" that is received in a groove in the valve housing 12'".

The compression release valve according to FIG. 6 functions principially in the same way as the valve of the embodiment according to FIG. 1, i.e. when the engine has started the bulb/valve element 28'" expands axially and a collar 29'" of the bulb/valve element 28'" seals against a seat 31'" provided in the cavity 20'" of the housing 12'". It should be pointed out that the space receiving the exhaust gases when the compression release valve is open constitutes the bearing space of the crank shaft (the crankcase). However, this functions in an excellent way since the pressure in this space is considerably lower than the pressure in the combustion chamber.

Significant for the compression release valve according to the present invention is that the housing 12;12';12";12'" is made out of a uniform material and that the bulb/valve element 28;28';28";28'" is made out of a different uniform material.

I claim:

1. A compression release valve (10;10';10";10'") for a combustion piston engine having a cylinder and a combustion chamber, said valve comprising a housing (12;12";12'") separate from the cylinder and having a chamber (20;20";20'"), said housing (12;12";12'") also having at least one hole (26;26'") that connects the chamber (20;20";20'") to a space separated from the combustion chamber (22;22") and a passage (24;24";24'") which connects the chamber (20;20";20'") to the combustion chamber (22;22"), and an element (28;28';28";28'") at least partly received in the chamber and having an end portion directly exposed to the combustion chamber, said element being made out of a material having a different coefficient of thermal expansion than the material that the housing (12; 12";12'") is made out of, and that upon rise of the temperature in the combustion chamber (22;22") a relative displacement between the element (28;28';28";28'") and the housing (12;12"12'") occurs, said displacement sealing the passage (24;24";24'").

2. A compression release valve (10;10';10'") according to claim 1, wherein the material that the element (28;28';28'") is made out of has a higher coefficient of thermal expansion than the material that the housing (12) is made out of.

3. A compression release valve (10;10') according to any of the preceding claims, wherein expansion of the element (28; 28') is used for sealing against a cooperating surface in the housing (12).

4. A compression release valve (10;10';10'") according to claim 1, wherein an end of the element (28;28';28'") facing away from the combustion chamber (22) contacts an insulation disc (34;34';34'") made out of a material having a low coefficient of thermal conductivity.

5. A compression valve (10;10';10'") according to claim 1, wherein the end portion of the element facing towards the combustion chamber (22;22") is provided with a cone (30;30") that seals the passage (24;24") upon relative displacement between the element (28;28") and the housing (12;12").

6. A compression relief valve (10') according to claim 1, wherein the element (28') has the shape of a shim that upon radial expansion of the element (28') seals against an inner wall of the housing (12).

7. A compression relief valve (10") according to claim 1, wherein the housing (12") is made out of a material having a higher coefficient of thermal expansion than the material that the element (28") is made out of.

8. A compression relief valve (10;10';10";10'") according to claim 1, wherein the higher coefficient of thermal expansion is at least ten times the lower coefficient of thermal expansion.

9. A compression relief valve (10;10';10";10'") according to claim 1, wherein the housing (12;12';12";12'") is made out of a uniform material and the element (28;28';28";28'") is made out of a different uniform material.

10. A combustion piston engine comprising at least one cylinder provided with a compression release valve according to claim 1.

11. A combustion piston engine comprising at least one piston provided with a compression release valve according to claim 1.

12. A compression relief valve according to claim 1, wherein the end portion of the element adjoins the combustion chamber.

13. A compression relief valve according to claim 1, wherein an end portion of the housing is directly exposed to the combustion chamber.

14. A compression relief valve according to claim 1, wherein an end portion of the housing adjoins the combustion chamber.

* * * * *